US011143186B2

(12) United States Patent
Kawasaki et al.

(10) Patent No.: US 11,143,186 B2
(45) Date of Patent: Oct. 12, 2021

(54) LIQUID RING VACUUM PUMP

(71) Applicant: Ebara Corporation, Tokyo (JP)

(72) Inventors: Hiroyuki Kawasaki, Tokyo (JP); Nozomu Sasaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 148 days.

(21) Appl. No.: 16/473,915

(22) PCT Filed: Dec. 8, 2017

(86) PCT No.: PCT/JP2017/044180
§ 371 (c)(1),
(2) Date: Jun. 26, 2019

(87) PCT Pub. No.: WO2018/139070
PCT Pub. Date: Aug. 2, 2018

(65) Prior Publication Data

US 2020/0141410 A1 May 7, 2020

(30) Foreign Application Priority Data

Jan. 30, 2017 (JP) ..... JP2017-014648
Feb. 14, 2017 (JP) ..... JP2017-025159

(51) Int. Cl.
*F04C 19/00* (2006.01)
*F04C 27/00* (2006.01)
*F04C 25/02* (2006.01)

(52) U.S. Cl.
CPC ..... *F04C 19/001* (2013.01); *F04C 19/00* (2013.01); *F04C 19/002* (2013.01);
(Continued)

(58) Field of Classification Search
CPC ..... F04C 19/00; F04C 19/004; F04C 19/007; F04C 19/008; F04C 19/005; F04C 19/002;
(Continued)

(56) References Cited

U.S. PATENT DOCUMENTS 1,792,741 A * 2/1931 Hayton ..... F04C 19/00 417/68
3,228,587 A * 1/1966 Segebrecht ..... F04C 28/02 417/62
4,050,851 A * 9/1977 Haavik ..... F04C 19/004 417/68
5,100,300 A * 3/1992 Haavik ..... F04C 19/002 417/68
(Continued)

FOREIGN PATENT DOCUMENTS

DE 617521 C 8/1935
JP 48-033643 B1 10/1973
(Continued)

OTHER PUBLICATIONS

Japan Patent Office, International Search Report in International Application No. PCT/JP2017/044180 (dated Feb. 27, 2018).

*Primary Examiner* — Peter J Bertheaud
(74) *Attorney, Agent, or Firm* — Leydig, Voit & Mayer, Ltd.

(57) ABSTRACT

The present invention relates to a two-stage liquid ring vacuum pump in which two-stage impellers are attached to an axial end portion of a main shaft (rotating shaft) of a motor. The two-stage liquid ring vacuum pump includes a first-stage impeller (4) provided in a first-stage pump chamber (1), a second-stage impeller (5) provided in a second-stage pump chamber (2), a single rotating shaft (7) to which the first-stage impeller (4) and the second-stage impeller (5) are fixed, and an exhaust port (Pd) of the first-stage pump chamber (1) and an intake port (Ps) of the second-stage pump chamber (2) which communicate with each other. An
(Continued)

outer diameter of the first-stage impeller (4) is larger than an outer diameter of the second-stage impeller (5).

9 Claims, 12 Drawing Sheets

(52) U.S. Cl.
CPC ..... *F04C 19/004* (2013.01); *F04C 19/005* (2013.01); *F04C 19/007* (2013.01); *F04C 19/008* (2013.01); *F04C 25/02* (2013.01); *F04C 27/009* (2013.01); *F04C 2240/30* (2013.01)

(58) Field of Classification Search
CPC ..... F04C 27/009; F04C 19/001; F04C 25/02; F04C 2240/30
See application file for complete search history.

(56) References Cited

U.S. PATENT DOCUMENTS

| | | | | |
|---|---|---|---|---|
| 6,514,052 | B2 * | 2/2003 | Bostwick | F04D 17/105 416/189 |
| 7,648,344 | B2 * | 1/2010 | Wenckebach | F04C 19/007 417/68 |
| 9,964,110 | B2 * | 5/2018 | Kosters | F04C 19/007 |

FOREIGN PATENT DOCUMENTS

| | | | |
|---|---|---|---|
| JP | S60-149895 | U | 10/1985 |
| JP | H02-43493 | U | 3/1990 |
| JP | H04-006790 | U | 1/1992 |
| JP | H05-87286 | U | 11/1993 |
| JP | H05-096482 | U | 12/1993 |
| JP | 2508668 | Y2 | 6/1996 |
| JP | 11-210655 | A | 8/1999 |
| JP | 2015-175322 | A | 10/2015 |
| JP | 2018-522163 | A | 8/2018 |

* cited by examiner

LIQUID RING VACUUM PUMP

CROSS-REFERENCE TO RELATED APPLICATIONS

This patent application is the U.S. national phase of International Application No. PCT/JP2017/044180, filed Dec. 8, 2017, which claims the benefit of Japanese Patent Application No. 2017-025159, filed on Feb. 14, 2017, and Japanese Patent Application No. 2017-014648, filed on Jan. 30, 2017, which are incorporated by reference in their entireties herein.

TECHNICAL FIELD

The present invention relates to a two-stage liquid ring vacuum pump in which two-stage impellers are attached to an axial end portion of a main shaft (rotating shaft) of a motor. Further, the present invention relates to a liquid ring vacuum pump which has a circular casing, an impeller attached eccentrically with respect to a center of the circular casing, and a shaft seal part provided in a portion where the main shaft for supporting the impeller passes through the casing.

BACKGROUND ART

There has been known a liquid ring vacuum pump, having a circular casing and an impeller attached eccentrically with respect to a center of the circular casing, wherein water or other liquid is enclosed within the casing, a liquid film (liquid ring) is formed along an inner wall of the casing by a centrifugal force caused by rotation of the impeller, and pumping action is performed by utilizing volumetric change of a blade chamber formed by the liquid film and adjacent two blades.

In the case where a high-vacuum liquid ring vacuum pump is designed, two-stage impellers or an ejector is used. However, both of them become large in size and in mass. Particularly, in the case of the two-stage impellers, in many cases, a rotating shaft to which two impellers are fixed is supported at both axial end portions of the rotating shaft by bearings, thus becoming long in an entire length of the vacuum pump.

In the case where a small-size and high-vacuum pump is designed, in a conventional pump structure in which the rotating shaft is supported at its both end portions, the vacuum pump becomes large in size. Therefore, in some cases, two-stage impellers are provided on an axial end portion of a rotating shaft of a direct acting motor to miniaturize the vacuum pump and to reduce a weight of the vacuum pump.

In the case where a two-stage liquid ring vacuum pump is designed, it is common practice to make a width of a first-stage impeller at a vacuum side larger than that of a second-stage impeller at an atmospheric pressure side, thereby increasing an exhaust velocity.

Patent document 1 (Japanese utility model registration No. 2508668) discloses a two-stage water ring vacuum pump, comprising a vacuum pump having two-stage impellers provided on an axial end portion of a rotating shaft of a direct acting motor, wherein a first-stage impeller 106 provided in a first-stage pump chamber 105 and a second-stage impeller 108 provided in a second-stage pump chamber 107 are fixed to the same rotating shaft, and an exhaust port of the first-stage pump chamber 105 communicates with an intake port of the second-stage pump chamber 107.

Further, the liquid ring vacuum pump is connected to a main shaft of a motor separately placed and is driven by such motor, or the liquid ring vacuum pump whose impeller is attached to a main shaft of a direct acting motor is driven by such direct acting motor. Furthermore, a shaft seal component such as a mechanical seal for performing shaft seal is provided in a portion where the main shaft for supporting the impeller passes through a casing at an exhaust side.

It is known that speeding up of the vacuum pump can make a diameter of the impeller smaller to miniaturize the vacuum pump and to reduce a weight of the vacuum pump. For example, if the motor for driving the vacuum pump is changed from a four-pole motor to a two-pole motor, the two-pole motor has a higher rotational velocity than the four-pole motor, and thus a diameter of the impeller driven by the two-pole motor is designed to be smaller than that of the impeller driven by the four-pole motor so that a shaft power does not become excessively large. In order to make a volume of the blade chamber formed by the adjacent two blades large to the utmost while keeping the diameter of the impeller small, a boss diameter of the impeller is made small. In the liquid ring vacuum pump, in order to perform intake and exhaust of gas in a space formed by the impeller, the casing and the liquid film, it is necessary to form the liquid film while narrowing a side clearance between the impeller and the casing.

CITATION LIST

Patent Literature

Patent document 1: Japanese utility model registration No. 2508668

Patent document 2: Japanese laid-open patent publication No. 2015-175322

SUMMARY OF INVENTION

Technical Problem

With regard to the above two-stage water ring vacuum pump, the following description is made in a paragraph [0004] of patent document 1.

"In the above two-stage water ring vacuum pump, intake air is compressed in the first-stage pump chamber 105 and then flows into the second-stage pump chamber 107 in a state where a volume of air is reduced. Therefore, it is necessary that a flow rate of air in the second-stage pump chamber 107 is set to be smaller depending on a degree of the compression than a flow rate of air in the first-stage pump chamber 105. Thus, in general, only a change of width dimensions of both impellers 106, 108 addresses the changes of the flow rate of air."

Specifically, as described in Patent document 1, in the conventional two-stage water ring vacuum pump, only a change of width dimensions of both impellers while keeping outer diameters of both impellers the same has addressed the changes of the flow rate of air caused by the compression.

In this manner, the reason why only a change of width dimensions of both impellers while keeping outer diameters of both impellers the same has been performed in the conventional two-stage water ring vacuum pump is considered as follows: plural designs of cross-sections perpendicular to an axis of the rotating shaft are required if the outer diameters of the impellers differ from each other at the time of designing the impellers, but only a single view of cross-section perpendicular to the axis of the rotating shaft is required if width dimensions of the impellers are changed, thus making the designing easier.

However, in the conventional method wherein only width dimensions of both impellers are changed while keeping outer diameters of both impellers the same in the two-stage water ring vacuum pump, in the case where the two-stage water liquid ring vacuum pump has a cantilever structure in which two-stage impellers are attached to an axial end portion of a rotating shaft of a motor, the rotating shaft having a cantilever structure becomes long to cause whirling vibration of the rotating shaft, resulting in performance degradation of the vacuum pump.

Further, in the conventional method in which only a change of width dimensions of both impellers while keeping outer diameters of both impellers the same is performed, when the exhaust velocity is increased to enhance ultimate vacuum, it is necessary to increase the width dimensions of both the two-stage impellers, thus making a rotating body including the cantilever-structured rotating shaft longer. In this case, as the cantilever-structured rotating shaft becomes longer, natural frequency of the rotating body including the rotating shaft becomes lower. Therefore, as the rotating shaft is rotated at a higher speed, the frequency of the rotating shaft is likely to come closer to the natural frequency (critical speed), thus being likely to cause resonance.

On the other hand, as described above, in the case of speeding up of the vacuum pump, in order to prevent the impeller from being brought into contact with the casing by deflection of the main shaft due to self-weight of the rotating body, the diameter of the main shaft is increased as much as possible with sufficient margin for strength. The dimension of the shaft seal component such as a mechanical seal is determined by the diameter of the main shaft. Therefore, as described above, if the main shaft is designed so that its diameter is increased as much as possible, an inner diameter of a housing space for housing the shaft seal component becomes larger than a boss diameter of the impeller at an exhaust side, and thus respective blade chambers communicate with each other through the housing space for housing the shaft seal component and accordingly the blade chambers as sealed spaces cannot be formed.

FIG. 11 is a schematic view showing main elements of a conventional liquid ring vacuum pump. As shown in FIG. 11, a shaft seal component 10B such as a mechanical seal for performing shaft seal is provided in a portion where a main shaft (rotating shaft) 7 for supporting a first-stage impeller 4 at an intake side and a second-stage impeller 5 at an exhaust side passes through an exhaust casing 9. In order to prevent the impeller from being brought into contact with the casing by pressure fluctuation in a blade chamber during operation or deflection of the main shaft due to self-weight of a rotating body, a diameter of the main shaft is increased as much as possible with sufficient margin for strength. Therefore, an inner diameter D3 of a housing space for housing the shaft seal component 10B in the exhaust casing 9 becomes larger than a boss diameter D4 of the second-stage impeller 5 at an exhaust side, and thus respective blade chambers formed by both side walls of the casing, the liquid film and the adjacent two blades communicate with each other through the housing space for housing the shaft seal component 10B and accordingly the blade chambers as sealed spaces cannot be formed.

In order to solve the above problem, conventionally, it has been necessary to design the vacuum pump in a manner such that the exhaust casing is divided into a plurality of segments, the diameter of the main shaft is made smaller, the boss diameter of the impeller is made larger, and another component is inserted into the housing space for housing the shaft seal component. However, such conventional measures have disadvantages such as an increase of the number of parts or pump size, resonance due to strength poverty, or a lowering of the exhaust velocity.

The present invention has been made in view of the above drawbacks. It is therefore an object of the present invention to provide a two-stage liquid ring vacuum pump, having a cantilever structure wherein two-stage impellers are attached to an axial end portion of a rotating shaft of a motor, which can shorten a length of the rotating shaft to prevent whirling vibration of the rotating shaft and can establish high natural frequency of a rotating body including the rotating shaft.

Further, another object of the present invention is to provide a liquid ring vacuum pump which can prevent respective blade chambers from communicating with each other through a housing space for housing a shaft seal component and can form the blade chambers as sealed spaces in the impeller without any design such as division of an exhaust casing, a decrease of a diameter of a main shaft, or an increase of a boss diameter of the impeller.

Solution to Problem

In order to achieve the above object, according to a first aspect of the present invention, there is provided a two-stage liquid ring vacuum pump comprising: a first-stage impeller provided in a first-stage pump chamber; a second-stage impeller provided in a second-stage pump chamber; a single rotating shaft to which the first-stage impeller and the second-stage impeller are fixed; and an exhaust port of the first-stage pump chamber and an intake port of the second-stage pump chamber which communicate with each other; wherein an outer diameter of the first-stage impeller is larger than an outer diameter of the second-stage impeller.

First, a technical idea of different diameters of impellers in the two-stage liquid ring vacuum pump will be described.

The liquid ring vacuum pump is configured such that water or other liquid is enclosed within a circular casing, attached eccentrically with respect to an axis of an impeller, at about half of the casing, a liquid film is formed along an inner wall of the casing by a centrifugal force caused by rotation of the impeller during operation, and pumping action is performed by volumetric change of each blade chamber sealed at its peripheral part by the liquid film.

As design specifications for the impeller used in the liquid ring vacuum pump, mainly, an outer diameter of an impeller, the number of blades, a thickness of blade, a width of impeller (axial dimension), a diameter of a shaft, a key portion, a rotational speed, an amount of eccentricity, and the like are enumerated, and an exhaust velocity and an output power are determined by the above specifications. The exhaust velocity is determined mainly by a volume of a blade chamber of a booster pump (impeller at an intake side: first-stage impeller), and the above specifications are determined to achieve a target exhaust velocity.

A main pump (impeller at an exhaust side: second-stage impeller) has a volume of a blade chamber smaller than a volume of a blade chamber of a booster pump (impeller at an intake side: first-stage impeller) because the main pump (second-stage impeller) performs intake and exhaust of gas compressed by the booster pump (first-stage impeller). Conventionally, only the width of the booster pump (impeller at an intake side: first-stage impeller) has been changed for reasons of easy designing, and the impeller having the changed width has been used. Therefore, it has been necessary to prepare the first-stage impeller and the second-stage impeller, respectively so as to be tailored to the specifications such as an output power, a frequency, or an exhaust velocity.

The present inventors focus attention on the idea that there is no inevitability such that the booster pump (impeller at an intake side: first-stage impeller) and the main pump (impeller at an exhaust side: second-stage impeller) have the same impeller specifications except for the width, and the booster pump (impeller at an intake side: first-stage impeller) and the main pump (impeller at an exhaust side: second-stage impeller) may have different outer diameters if the volume of the blade chamber can be changed. The impeller specifications such as an amount of eccentricity, the number of blades, and a thickness of blade, except for the outer diameters may be designed differently in respective impellers.

According to the present invention, the outer diameter of the first-stage impeller at an intake side is larger than that of the second-stage impeller at an exhaust side to increase the exhaust velocity. In this case, the width of the first-stage impeller should be equal to or larger than the width of the second-stage impeller. As an effect of the method for achieving an increase of the exhaust velocity by making the outer diameter of the first-stage impeller larger without making the width of the first-stage impeller larger, the length of the rotating shaft can be shortened and the natural frequency of the rotating body including the rotating shaft can be set to a higher value, compared to the case where the width of the first-stage impeller is made larger, thus achieving a stable rotating state of the rotating body easily.

In a preferred embodiment of the present invention, an axial width of the first-stage impeller is equal to or larger than an axial width of the second-stage impeller.

In a preferred embodiment of the present invention, an outer diameter of a housing portion of a casing for housing the first-stage impeller is larger than an outer diameter of a housing portion of a casing for housing the second-stage impeller.

In a preferred embodiment of the present invention, an outer diameter of a boss portion of the first-stage impeller is equal to or larger than an outer diameter of a boss portion of the second-stage impeller.

In a preferred embodiment of the present invention, in a plurality of types of vacuum pumps having different exhaust velocities, the second-stage impellers use a common impeller.

According to a second aspect of the present invention, there is provided a liquid ring vacuum pump comprising: a casing for housing a sealing liquid; at least one impeller housed in the casing; and a shaft seal component provided in a portion where a main shaft for supporting the impeller passes through the casing; wherein the impeller comprises a cylindrical boss portion having a hole for allowing the main shaft to be inserted therein, a plurality of blades extending radially outwardly from the boss portion, and a circular ring-shaped side plate extending radially outwardly from an outer circumference of the boss portion and positioned at a side facing the shaft seal component; and wherein an outer diameter of the side plate is larger than an inner diameter of a housing space, for housing the shaft seal component, formed in the casing.

In a preferred embodiment of the present invention, the side plate has at least one end surface which is in parallel with a plane perpendicular to an axial direction of the main shaft.

In a preferred embodiment of the present invention, the side plate is connected to an end surface in a width direction of each blade and an inner end in a radial direction of each blade.

In a preferred embodiment of the present invention, the impeller having the boss portion, the plurality of blades and the side plate is integrally formed by casting.

In a preferred embodiment of the present invention, the liquid ring vacuum pump further comprises a connecting ring formed in a circular ring shape for connecting the plurality of blades in a state where adjacent two blades are connected to each other; wherein the connecting ring is positioned at an end portion in a width direction of each blade, and is positioned radially outwardly of the side plate.

In a preferred embodiment of the present invention, the connecting ring has a tapered cross-sectional shape which is tapered from an end portion side in a width direction of each blade toward an inner side in the width direction of each blade.

In a preferred embodiment of the present invention, the liquid ring vacuum pump comprises a two-stage liquid ring vacuum pump having a first-stage impeller at an intake side and a second-stage impeller at an exhaust side; and the side plate is provided on the second-stage impeller.

Advantageous Effects of Invention

According to the two-stage liquid ring vacuum pump of the present invention, by making the outer diameter of the first-stage impeller at an intake side larger, the width of the first-stage impeller can be reduced. Therefore, the length of the cantilever-structured rotating shaft can be shortened, compared to the conventional method in which only a change of width dimensions of both impellers while keeping outer diameters of both impellers the same is performed. Thus, whirling vibration of the rotating shaft can be prevented and there is no fear of performance degradation of the vacuum pump. Further, the natural frequency of the rotating body including the rotating shaft can be set to a high value, and thus there is no fear of coming close to the critical speed even if the rotating shaft is rotated at a high speed, thus causing no resonance. Therefore, a stable rotating state of the rotating body including the rotating shaft can be easily realized.

According to the liquid ring vacuum pump of the present invention, respective blade chambers can be prevented from communicating with each other through a housing space for housing a shaft seal component, and the respective blade chambers as sealed spaces can be formed in the impeller without any design such as division of an exhaust casing, a decrease of a diameter of a main shaft, or an increase of a boss diameter of the impeller.

DESCRIPTION OF EMBODIMENTS

Figure 1:
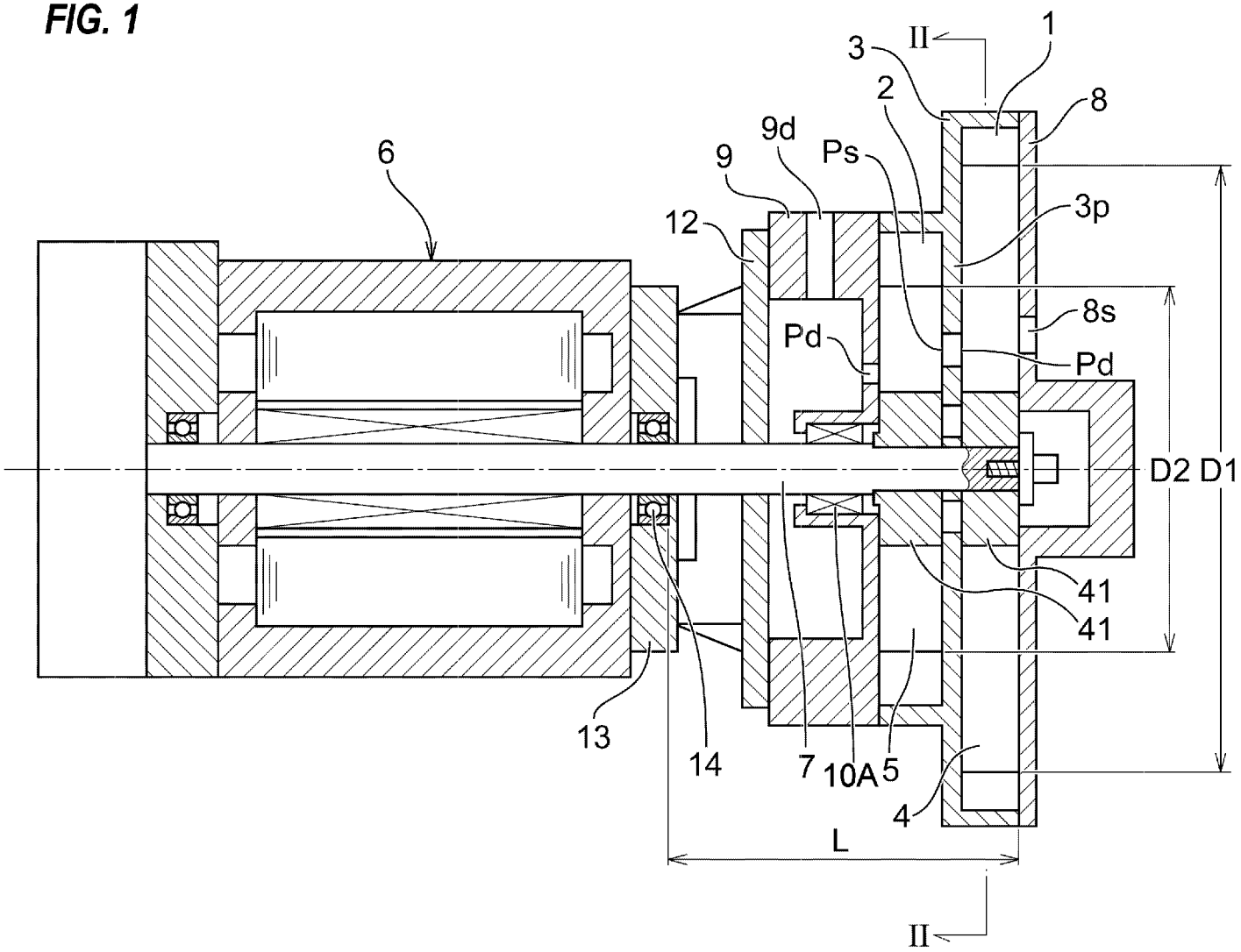
FIG. 1 is a schematic cross-sectional view showing an embodiment of a two-stage liquid ring vacuum pump according to a first aspect of the present invention.

A two-stage liquid ring vacuum pump according to a first aspect of the present invention will be described below with reference to FIGS. 1 through 6B. Like or corresponding structural elements are denoted by like or corresponding reference numerals in FIGS. 1 through 6B and will not be described below in duplication.

FIG. 1 is a schematic cross-sectional view showing a two-stage liquid ring vacuum pump according to the present invention. As shown in FIG. 1, the two-stage liquid ring vacuum pump includes a casing 3 for forming a first-stage pump chamber 1 and a second-stage pump chamber 2 therein. A first-stage impeller 4 is provided in the first-stage pump chamber 1, and a second-stage impeller 5 is provided in the second-stage pump chamber 2. The first-stage impeller 4 and the second-stage impeller 5 are fixed to the same rotating shaft 7 of a direct acting motor 6. A partition wall 3*p* extending radially inwardly is formed at a central portion of the casing 3, and the first-stage pump chamber 1 and the second-stage pump chamber 2 are partitioned with the partition wall 3*p*. An exhaust port Pd of the first-stage pump chamber 1 and an intake port Ps of the second-stage pump chamber 2 are formed in the partition wall 3*p*, and the first-stage pump chamber 1 and the second-stage pump chamber 2 communicate with each other by the exhaust port Pd and the intake port Ps.

An opening portion at a front end side of the casing 3 is covered with an intake-side cover 8, and the first-stage pump chamber 1 as a sealed space is formed by the intake-side cover 8. An opening portion at a rear end side of the casing 3 is covered with an exhaust casing 9, and the second-stage pump chamber 2 as a sealed space is formed by the exhaust casing 9. A suction port 8*s* is formed in the intake-side cover 8, and gas (e.g., air) is drawn from the suction port 8*s* into the first-stage pump chamber 1. An exhaust port Pd of the second-stage pump chamber 2 is formed in the exhaust casing 9. Further, a discharge port 9*d* is formed in the exhaust casing 9, and the gas discharged from the second-stage pump chamber 2 through the exhaust port Pd is discharged from the discharge port 9*d* to the outside. A mechanical seal 10A as a shaft seal device is installed in a portion where the rotating shaft 7 passes through the exhaust casing 9. An opening portion of the exhaust casing 9 is covered with a motor flange 12.

As shown in FIG. 1, the first-stage impeller 4 and the second-stage impeller 5 are attached to an axial end portion of the rotating shaft 7 of the motor 6. The rotating shaft 7 for supporting the first-stage impeller 4 and the second-stage impeller 5 is supported in a cantilever structure (overhang structure) by a bearing 14 provided in a motor casing 13 of the motor 6. An outer diameter D1 of the first-stage impeller 4 at a vacuum side (intake side) is set to be larger than an outer diameter D2 of the second-stage impeller 5 at an atmospheric pressure side (exhaust side). In FIG. 1, the casing for housing the first-stage impeller 4 and the second-stage impeller 5 is illustrated as a single casing 3. In the single casing 3, an outer diameter of a housing part for housing the first-stage impeller 4 is set to be larger than an outer diameter of a housing part for housing the second-stage impeller 5. If the first-stage impeller 4 and the second-stage impeller 5 are housed by separate casings, respectively, an outer diameter of the casing for housing the first-stage impeller 4 is set to be larger than an outer diameter of the casing for housing the second-stage impeller 5.

Figure 2:
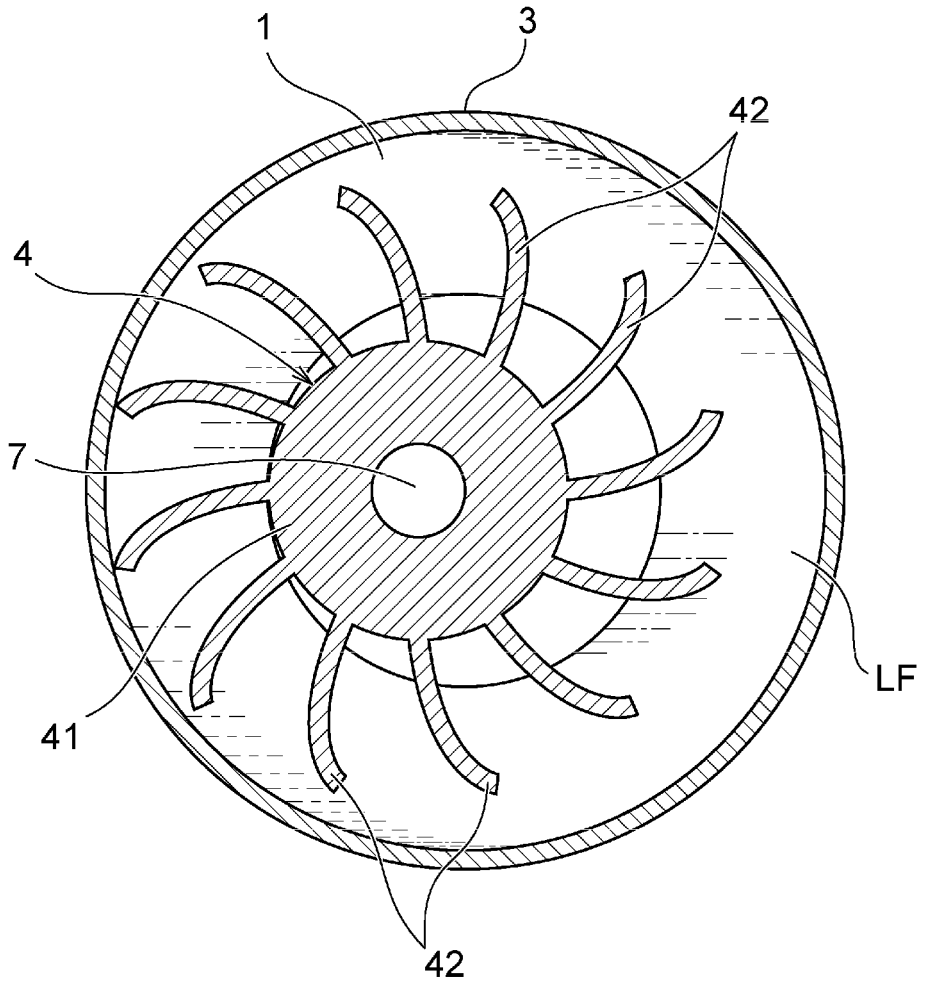
FIG. 2 is a view showing details of a first-stage pump chamber and a first-stage impeller disposed in the first-stage pump chamber, and a cross-sectional view taken along a line II-II of FIG. 1.

FIG. 2 is a view showing details of the first-stage pump chamber 1 and the first-stage impeller 4 disposed in the first-stage pump chamber 1, and a cross-sectional view taken along a line II-II of FIG. 1. As shown in FIG. 2, the casing 3 has a circular interior space therein, and the interior space constitutes the first-stage pump chamber 1. The first-stage impeller 4 is fixed to the rotating shaft 7, and the first-stage impeller 4 is eccentrically positioned with respect to the circular interior space (first-stage pump chamber 1) of the casing 3. The first-stage impeller 4 comprises a cylindrical boss portion 41 having a large thickness, and a plurality of blades 42 extending radially from the boss portion 41 at regular intervals. In FIG. 2, the first-stage impeller 4 is rotated in a counterclockwise direction. Each of the plurality of blades 42 has a radially outward portion which is curved toward a rotational direction. The interior space of the casing 3 is supplied with a liquid (e.g., water) having an amount which fills about half a volume of the interior space of the casing 3. When the first-stage impeller 4 is rotated, the plurality of blades 42 scrape out the liquid in an outer circumferential direction of the first-stage impeller 4, whereby the liquid rotates along an inner surface of the casing 3 by a centrifugal force, thus forming an annular liquid film (liquid ring) LF. In the first-stage pump chamber 1, pumping action is performed to compress the gas by utilizing volumetric change of each blade chamber formed by the liquid film LF and the adjacent two blades 42. Although the first-stage pump chamber 1 and the first-stage impeller 4 are shown in FIG. 2, the second-stage pump chamber 2 and the second-stage impeller 5 have the same configuration even though sizes of the second-stage pump chamber 2 and the second-stage impeller 5 (inner diameter of pump chamber, outer diameter of impeller) are different from those of the first-stage pump chamber 1 and the first-stage impeller 4.

An outer diameter of the boss portion 41 of the first-stage impeller 4 is equal to or larger than an outer diameter of the boss portion of the second-stage impeller 5. Although FIGS. 1 and 2 show the embodiment in which the outer diameter of the boss portion 41 of the first-stage impeller 4 is equal to the outer diameter of the boss portion 41 of the second-stage impeller 5, FIGS. 3 and 4 are schematic cross-sectional views showing embodiments in which an outer diameter of the boss portion 41 of the first-stage impeller 4 is larger than an outer diameter of the boss portion 41 of the second-stage impeller 5.

Figure 3:
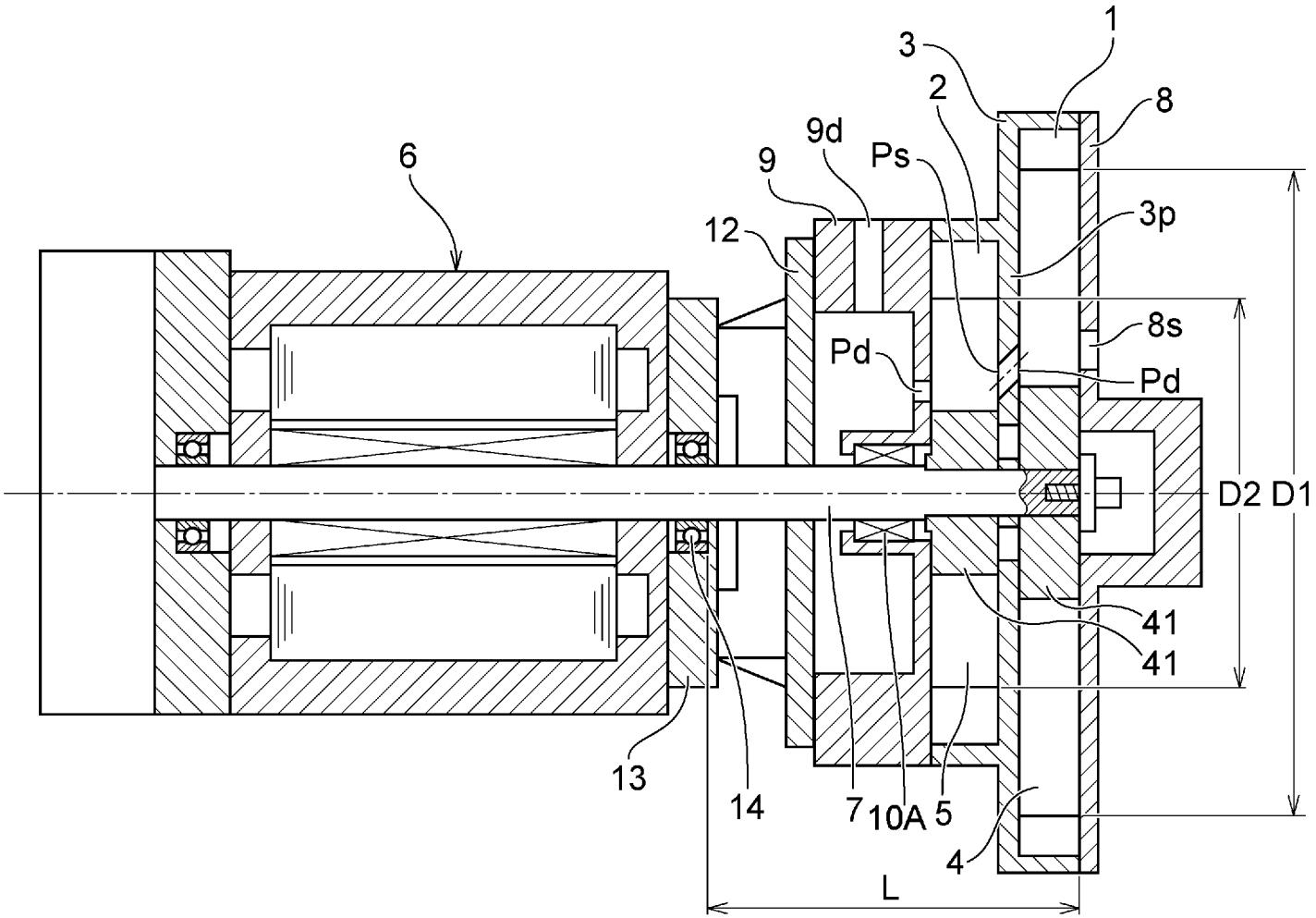
FIG. 3 is a schematic cross-sectional view showing an embodiment in which an outer diameter of a boss portion of the first-stage impeller is larger than that of a boss portion of the second-stage impeller.

In the embodiment shown in FIG. 3, an outer diameter of the boss portion 41 of the first-stage impeller 4 is larger than an outer diameter of the boss portion 41 of the second-stage impeller 5, and the exhaust port Pd and the intake port Ps formed in the partition wall 3*p* communicate with each other obliquely.

Figure 4:
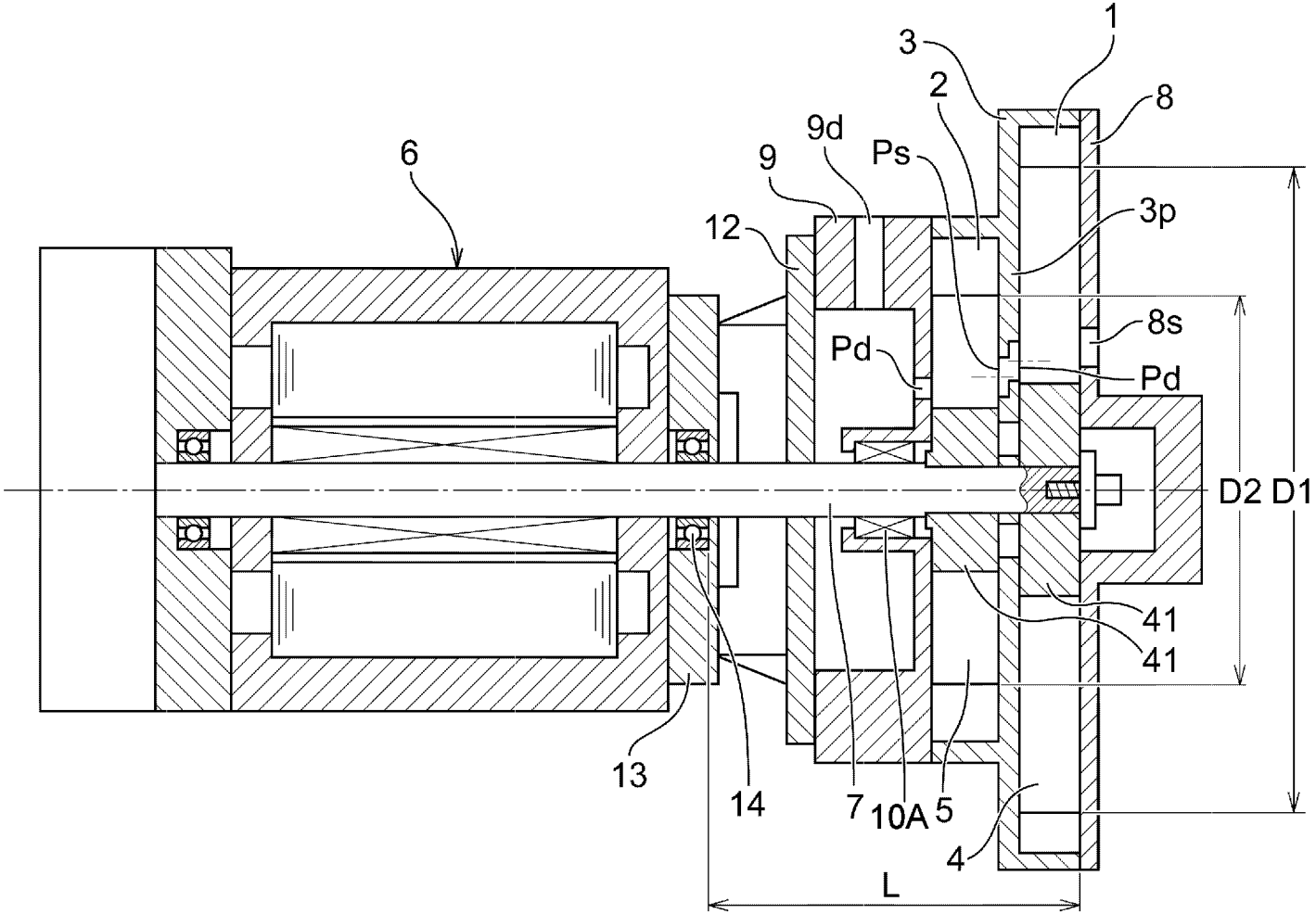
FIG. 4 is a schematic cross-sectional view showing an embodiment in which an outer diameter of a boss portion of the first-stage impeller is larger than that of a boss portion of the second-stage impeller.

In the embodiment shown in FIG. 4, an outer diameter of the boss portion 41 of the first-stage impeller 4 is larger than an outer diameter of the boss portion 41 of the second-stage impeller 5, and the exhaust port Pd and the intake port Ps formed in the partition wall 3*p* communicate with each other in a state where their central axes deviate from each other.

Figure 5A:
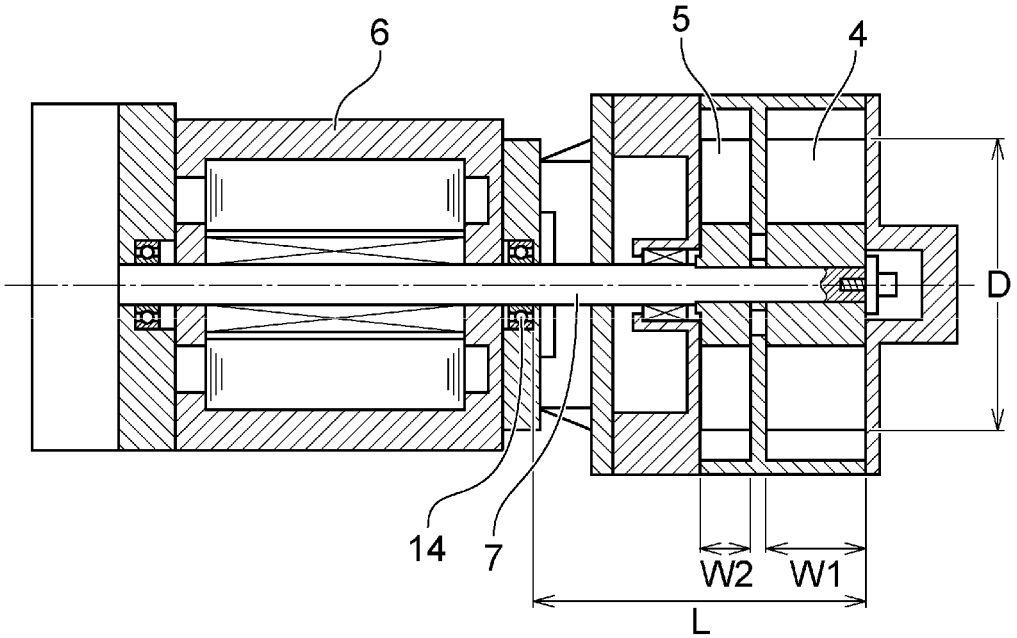
FIG. 5A is a schematic view showing a conventional two-stage liquid ring vacuum pump wherein only width dimensions of both impellers are changed while keeping outer diameters of both impellers the same.
Figure 5B:
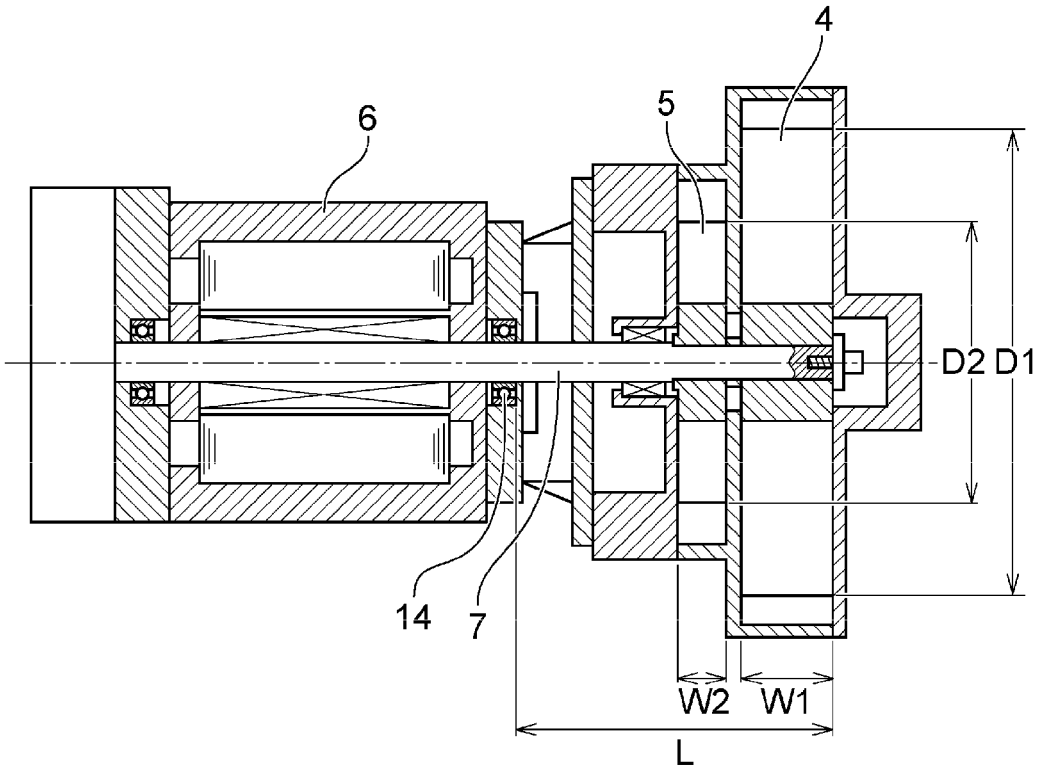
FIG. 5B is a schematic view showing a two-stage liquid ring vacuum pump according to the present invention wherein an outer diameter of the first-stage impeller at a vacuum side (intake side) is larger than that of the second-stage impeller at an atmospheric pressure side (exhaust side)

FIGS. 5A and 5B are schematic views showing a conventional two-stage liquid ring vacuum pump (FIG. 5A) wherein only width dimensions of both impellers are changed while keeping outer diameters of both impellers the same and showing a two-stage liquid ring vacuum pump (FIG. 5B) according to the present invention wherein the outer diameter of the first-stage impeller 4 at a vacuum side (intake side) is larger than that of the second-stage impeller 5 at an atmospheric pressure side (exhaust side). In FIGS. 5A and 5B, two impellers are schematically shown in a condition where both vacuum pumps have the same exhaust velocity.

In the conventional two-stage liquid ring vacuum pump shown in FIG. 5A, the first-stage impeller 4 at a vacuum side and the second-stage impeller 5 at an atmospheric pressure side have the same outer diameter D, and a width W1 of the first-stage impeller 4 is larger than a width W2 of the second-stage impeller 5. In this manner, in the conventional two-stage liquid ring vacuum pump, as described in Patent document 1, only width dimensions of both impellers 4, 5 are changed to cope with the changes of the flow rate of air.

In the two-stage liquid ring vacuum pump according to the present invention shown in FIG. 5B, an outer diameter D1 of the first-stage impeller 4 at a vacuum side (intake side) is larger than an outer diameter D2 of the second-stage impeller 5 at an atmospheric pressure side (exhaust side). In this manner, according to the present invention, the outer diameter of the first-stage impeller 4 is larger than the outer diameter of the second-stage impeller 5 to cope with the changes of the flow rate of air. Thus, as shown in FIG. 5B, a width W1 of the first-stage impeller 4 can be smaller than the width W1 of the conventional first-stage impeller 4 shown in FIG. 5A, and thus the length L of the cantilever-structured rotating shaft 7 can be shortened.

Figure 6A:
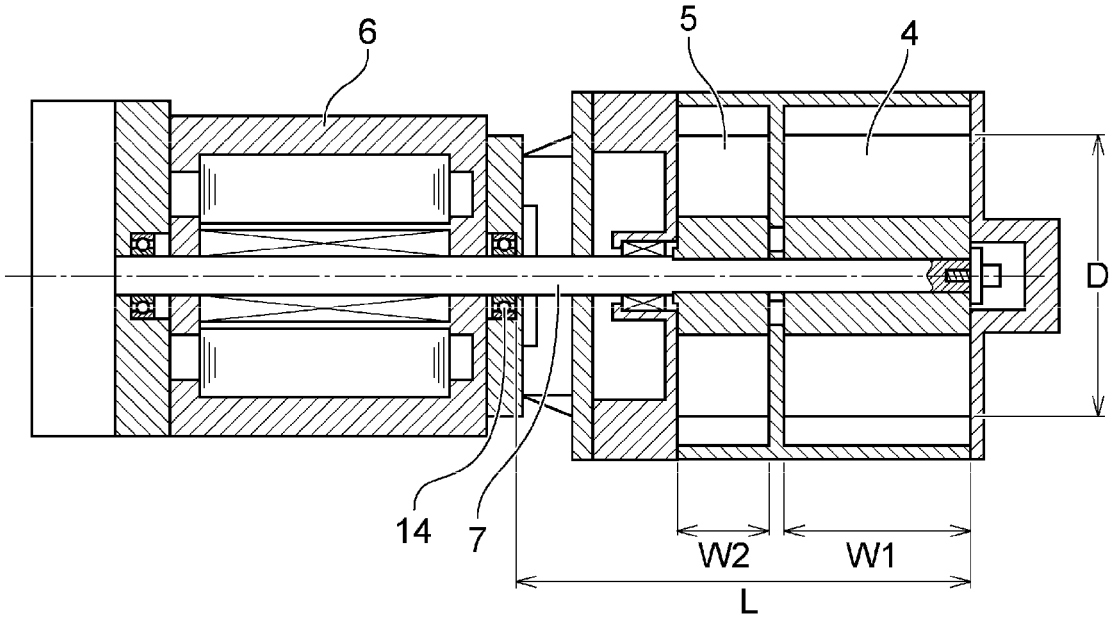
FIG. 6A is a view showing a two-stage liquid ring vacuum pump wherein an exhaust velocity of the vacuum pump is larger than exhaust velocities of the vacuum pumps shown in FIGS. 5A and 5B, and a schematic view showing a conventional two-stage liquid ring vacuum pump wherein only width dimensions of both impellers are changed.
Figure 6B:
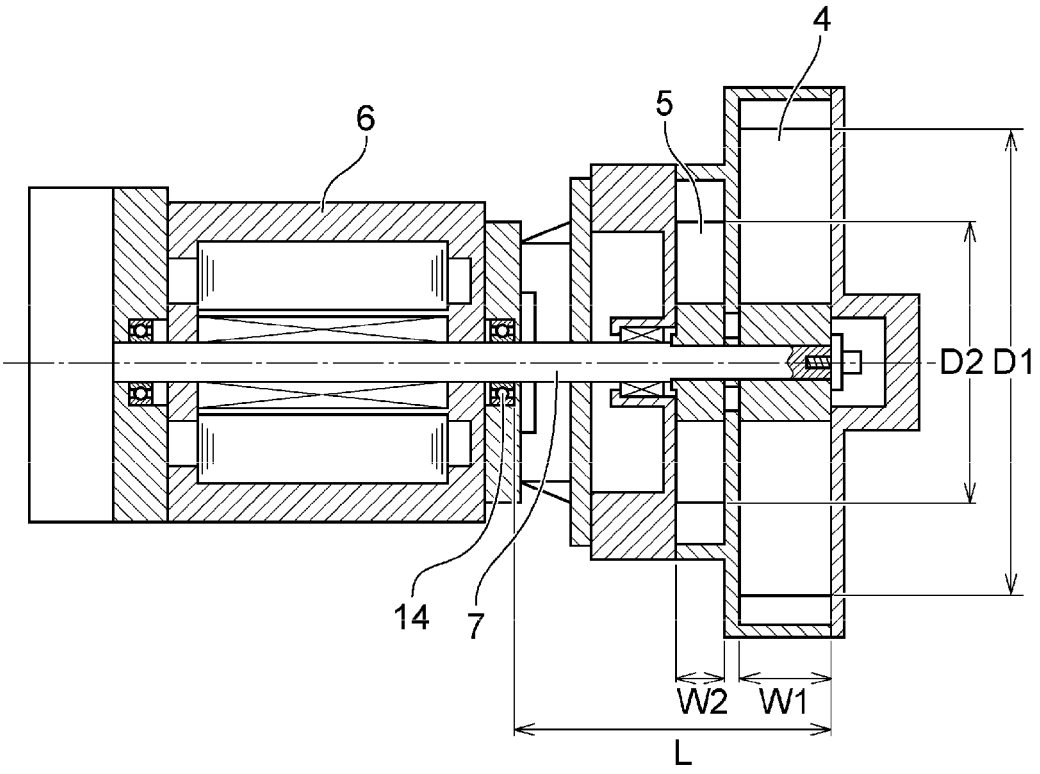
FIG. 6B is a schematic view showing a two-stage liquid ring vacuum pump according to the present invention wherein the outer diameter of the first-stage impeller at a vacuum side (intake side) is larger than that of the second-stage impeller at an atmospheric pressure side (exhaust side)

FIGS. 6A and 6B are views showing two-stage liquid ring vacuum pumps wherein exhaust velocities of the vacuum pumps are larger than those of the vacuum pumps shown in FIGS. 5A and 5B, and schematic views showing a conventional two-stage liquid ring vacuum pump (FIG. 6A) wherein only width dimensions of both impellers are changed and a two-stage liquid ring vacuum pump (FIG. 6B) according to the present invention wherein the outer diameter of the first-stage impeller 4 at a vacuum side (intake side) is larger than that of the second-stage impeller 5 at an atmospheric pressure side (exhaust side). In FIGS. 6A and 6B, two impellers are schematically shown in a condition where both vacuum pumps have the same exhaust velocity, respectively.

In the conventional two-stage liquid ring vacuum pump shown in FIG. 6A, the first-stage impeller 4 at a vacuum side (intake side) and the second-stage impeller 5 at an atmospheric pressure side (exhaust side) have the same outer diameter D, and a width W1 of the first-stage impeller 4 is larger than a width W2 of the second-stage impeller 5. In this manner, in the conventional two-stage liquid ring vacuum pump, only width dimensions of both impellers 4, 5 are changed to cope with the changes of the flow rate of air.

Further, because the exhaust velocity of the vacuum pump shown in FIG. 6A is set to be larger than that of the vacuum pump shown in FIG. 5A, the width W1 of the first-stage impeller 4 and the width W2 of the second-stage impeller 5 in the vacuum pump shown in FIG. 6A are increased, respectively, compared to the vacuum pump shown in FIG. 5A.

In the two-stage liquid ring vacuum pump according to the present invention shown in FIG. 6B, an outer diameter D1 of the first-stage impeller 4 at a vacuum side (intake side) is larger than an outer diameter D2 of the second-stage impeller 5 at an atmospheric pressure side (exhaust side). In this manner, according to the present invention, the outer diameter of the first-stage impeller 4 is larger than the outer diameter of the second-stage impeller 5 to cope with the changes of the flow rate of air. Thus, as shown in FIG. 6B, a width W1 of the first-stage impeller 4 can be smaller than the width W1 of the conventional first-stage impeller 4 shown in FIG. 6A, and thus the length L of the cantilever-structured rotating shaft 7 can be shortened.

Further, because the exhaust velocity of the vacuum pump shown in FIG. 6B is set to be larger than that of the vacuum pump shown in FIG. 5B, the width W1 of the first-stage impeller 4 is increased, compared to the vacuum pump shown in FIG. 5B. However, according to the present invention, with respect to the second-stage impeller 5, the vacuum pump shown in FIG. 5B and the vacuum pump shown in FIG. 6B use the common second-stage impeller 5.

As is clear from FIGS. 5A and 5B and FIGS. 6A and 6B, by making the outer diameter of the first-stage impeller 4 at a vacuum side large, the width W1 of the first-stage impeller 4 can be reduced. Therefore, the length of the cantilever-structured rotating shaft 7 can be shortened, compared to the conventional method in which only width dimensions of both impellers are changed while keeping outer diameters of both impellers the same. Thus, the whirling vibration of the rotating shaft 7 can be prevented and there is no fear of performance degradation of the vacuum pump. Further, the natural frequency of the rotating body including the rotating shaft 7 can be set to a high value, and thus there is no fear of coming close to the critical speed even if the rotating shaft 7 is rotated at a high speed, thus causing no resonance. Therefore, a stable rotating state of the rotating body including the rotating shaft 7 can be easily realized.

As shown in FIGS. 5B and 6B, according to the present invention, even if the exhaust velocity of the vacuum pump is changed, the second-stage impellers 5 in the two vacuum pumps can use the same impeller. Specifically, the plural types of vacuum pumps having different exhaust velocities can share the second-stage impeller 5 as the main pump (exhaust-side impeller). Therefore, the second-stage impeller 5 and components such as a casing for housing the second-stage impeller 5 can be shared in the plural types of vacuum pumps.

A liquid ring vacuum pump according to a second aspect of the present invention will be described below with reference to FIGS. 7 through 10C. Like or corresponding structural elements are denoted by like or corresponding reference numerals in FIGS. 7 through 10C and will not be described below in duplication.

Figure 7:
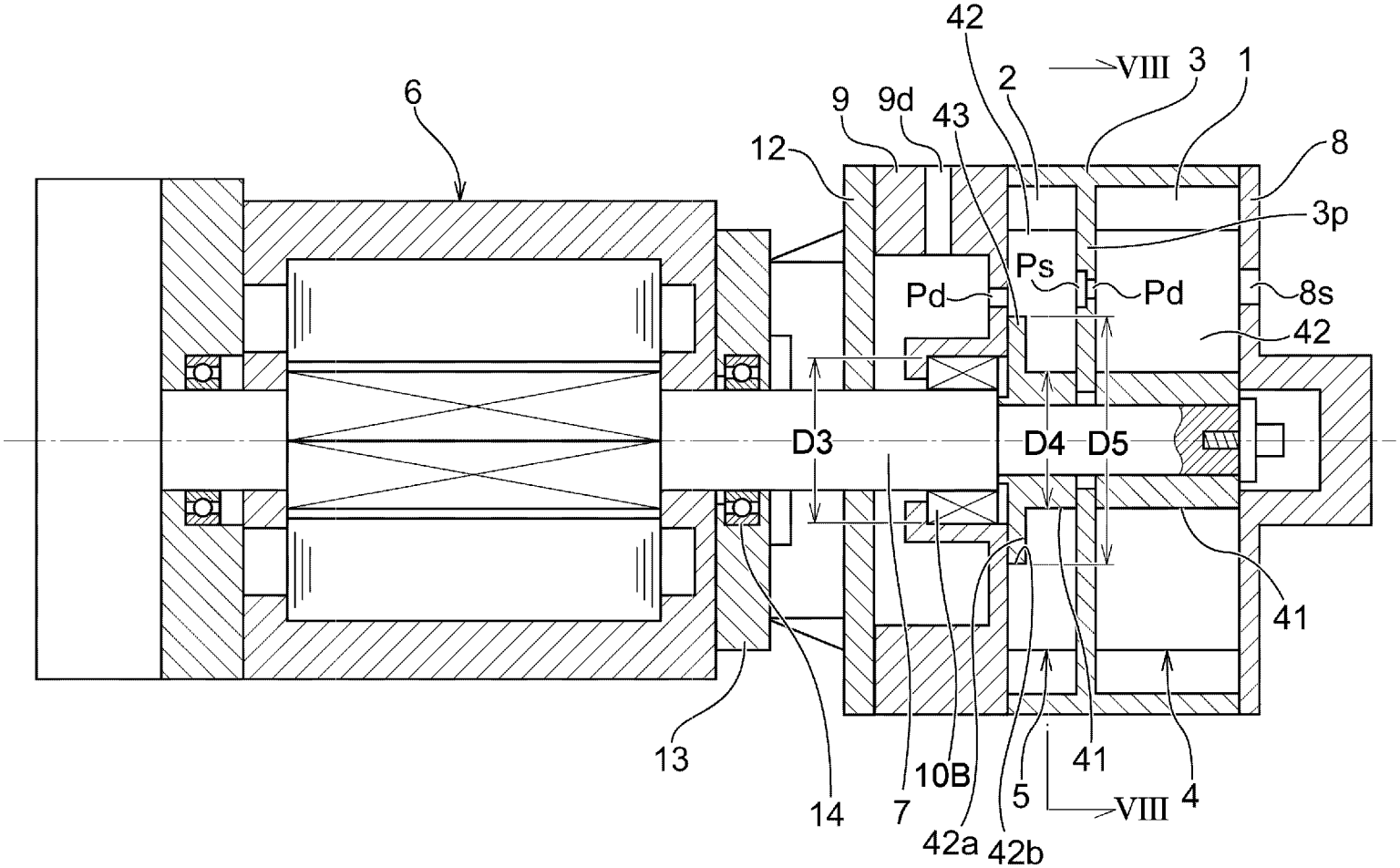
FIG. 7 is a schematic cross-sectional view showing an embodiment of a liquid ring vacuum pump according to a second aspect of the present invention.

FIG. 7 is a schematic cross-sectional view showing an embodiment of a liquid ring vacuum pump according to the present invention. In FIG. 7, as an example of the liquid ring vacuum pump, a two-stage liquid ring vacuum pump is shown. As shown in FIG. 7, the two-stage liquid ring vacuum pump includes a casing 3 for forming a first-stage pump chamber 1 and a second-stage pump chamber 2 therein. A first-stage impeller 4 at an intake side is provided in the first-stage pump chamber 1, and a second-stage impeller 5 at an exhaust side is provided in the second-stage pump chamber 2. The first-stage impeller 4 and the second-stage impeller 5 are fixed to the same main shaft (rotating shaft) 7 of a direct acting motor 6. A partition wall 3*p* extending radially inwardly is formed at a central portion of the casing 3, and the first-stage pump chamber 1 and the second-stage pump chamber 2 are partitioned with the partition wall 3*p*. An exhaust port Pd of the first-stage pump chamber 1 and an intake port Ps of the second-stage pump chamber 2 are formed in the partition wall 3*p*, and the first-stage pump chamber 1 and the second-stage pump chamber 2 communicates with each other by the exhaust port Pd and the intake port Ps.

An opening portion at a front end side of the casing 3 is covered with an intake-side cover 8, and the first-stage pump chamber 1 as a sealed space is formed by the intake-side cover 8. An opening portion at a rear end side of the casing 3 is covered with an exhaust casing 9, and the second-stage pump chamber 2 as a sealed space is formed by the exhaust casing 9. A suction port 8*s* is formed in the intake-side cover 8, and gas (e.g., air) is drawn from the suction port 8*s* into the first-stage pump chamber 1. An exhaust port Pd of the second-stage pump chamber 2 is formed in the exhaust casing 9. Further, a discharge port 9*d* is formed in the exhaust casing 9, and the gas discharged from the second-stage pump chamber 2 through the exhaust port Pd is discharged from the discharge port 9*d* of the exhaust casing 9 to the outside. A shaft seal component 10B such as a mechanical seal for performing shaft seal is installed in a portion where the main shaft 7 passes through the exhaust casing 9. An opening portion of the exhaust casing 9 is covered with a motor flange 12.

As shown in FIG. 7, the first-stage impeller 4 and the second-stage impeller 5 comprise a cylindrical boss portion 41, and a plurality of blades 42 extending radially from the boss portion 41 at regular intervals, respectively. A circular ring-shaped side plate 43 extending radially outwardly from an outer circumference of the boss portion 41 is formed on the boss portion 41 of the second-stage impeller 5 at an exhaust side, and the circular ring-shaped side plate 43 is positioned at a side facing a housing space for housing the shaft seal component 10B. An outer diameter D5 of the side plate 43 is set to be larger than an inner diameter D3 of the housing space for housing the shaft seal component 10B. Specifically, the relationship between the inner diameter D3 of the housing space for housing the shaft seal component 10B, a boss diameter D4 of the second-stage impeller 5, and the outer diameter D5 of the side plate 43 in the second-stage impeller 5 is set to D5>D3>D4. Therefore, a side facing the housing space for housing the shaft seal component 10B in each blade chamber formed by the liquid film and the adjacent two blades 42, and a boss portion side (base side) are covered with the side plate 43 having the outer diameter D5 larger than the inner diameter D3 of the housing space for housing the shaft seal component 10B. Thus, the respective blade chambers each formed by both side walls of the casing, the liquid film and the two adjacent blades 42 do not communicate with each other through the housing space for housing the shaft seal component 10B, whereby the respective blade chambers as sealed spaces can be formed.

As shown in FIG. 7, the first-stage impeller 4 and the second-stage impeller 5 are attached to an axial end portion of the main shaft 7 of the motor 6. The main shaft 7 for supporting the first-stage impeller 4 and the second-stage impeller 5 is supported in a cantilever structure (overhang structure) by a bearing 14 provided in a motor casing 13 of the motor 6. In FIG. 7, although the casing for housing the first-stage impeller 4 and the second-stage impeller 5 is illustrated as a single casing 3, the first-stage impeller 4 and the second-stage impeller 5 may be housed by separate casings, respectively.

Figure 8:
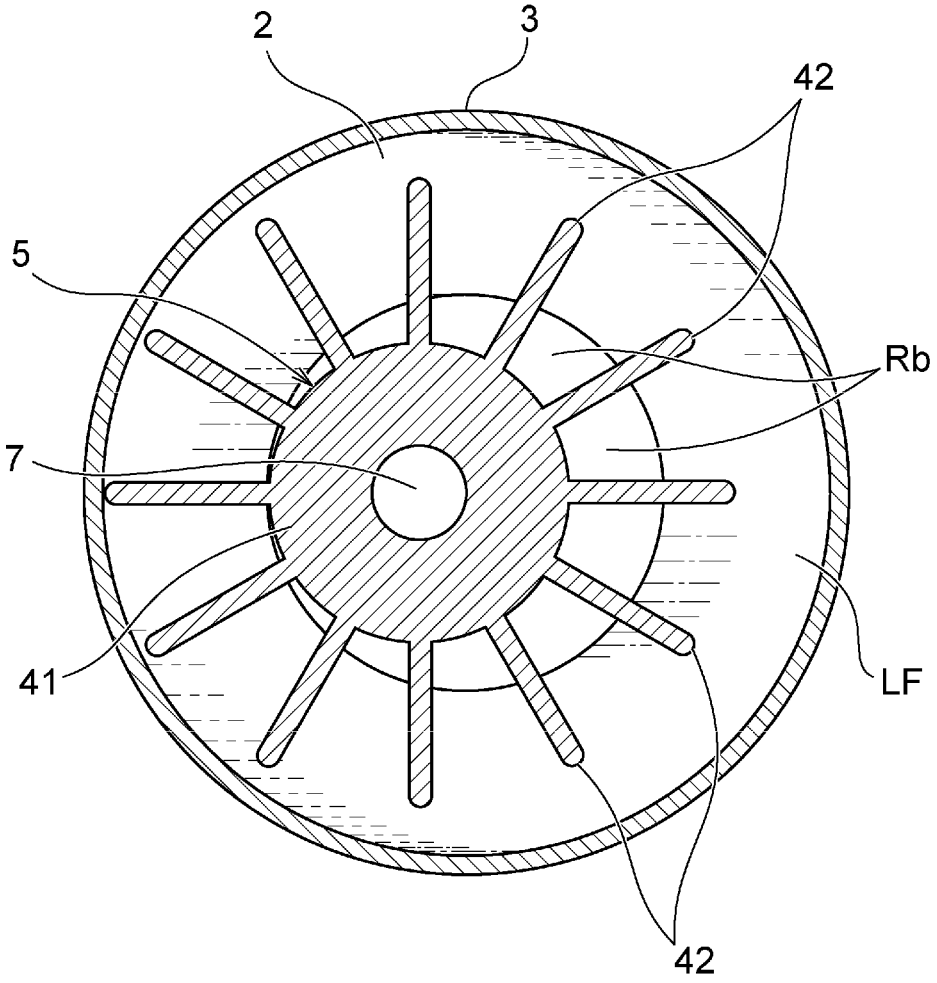
FIG. 8 is a view showing details of a second-stage pump chamber and a second-stage impeller disposed in the second-stage pump chamber, and a cross-sectional view taken along a line VIII-VIII of FIG. 7.

FIG. 8 is a view showing details of the second-stage pump chamber 2 and the second-stage impeller 5 disposed in the second-stage pump chamber 2, and a cross-sectional view taken along a line VIII-VIII of FIG. 7. As shown in FIG. 8, the casing 3 has a circular interior space therein, and the interior space constitutes the second-stage pump chamber 2. The second-stage impeller 5 is fixed to the main shaft 7, and the second-stage impeller 5 is eccentrically positioned with respect to the circular interior space (second-stage pump chamber 2). The second-stage impeller 5 comprises a cylindrical boss portion 41, and a plurality of blades 42 extending radially from the boss portion 41 at regular intervals. In FIG. 8, the interior space of the casing 3 is supplied with a liquid (e.g., water) having an amount which fills about half a volume of the interior space of the casing 3. When the second-stage impeller 5 is rotated, the plurality of blades 42 scrape out the liquid in an outer circumferential direction of the second-stage impeller 5, whereby the liquid rotates along an inner surface of the casing 3 by a centrifugal force, thus forming an annular liquid film (liquid ring) LF. In the second-stage pump chamber 2, pumping action is performed to compress the gas by utilizing volumetric change of each blade chamber Rb formed by both side walls of the casing, the liquid film LF and the adjacent two blades 42.

Figure 9A:
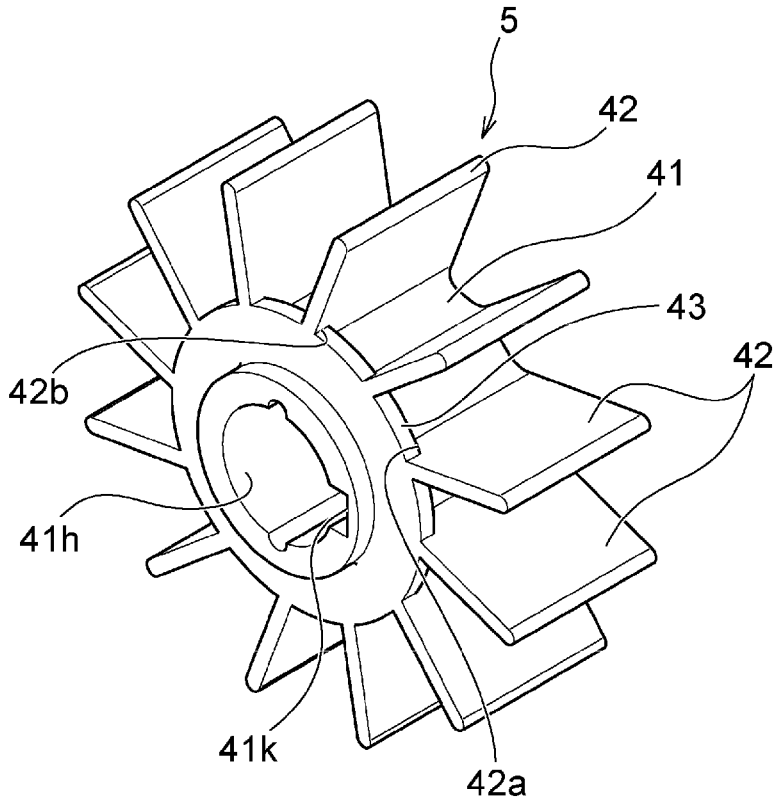
FIG. 9A is a perspective view showing the second-stage impeller according to the present invention shown in FIG. 7 and FIG. 8.
Figure 9B:
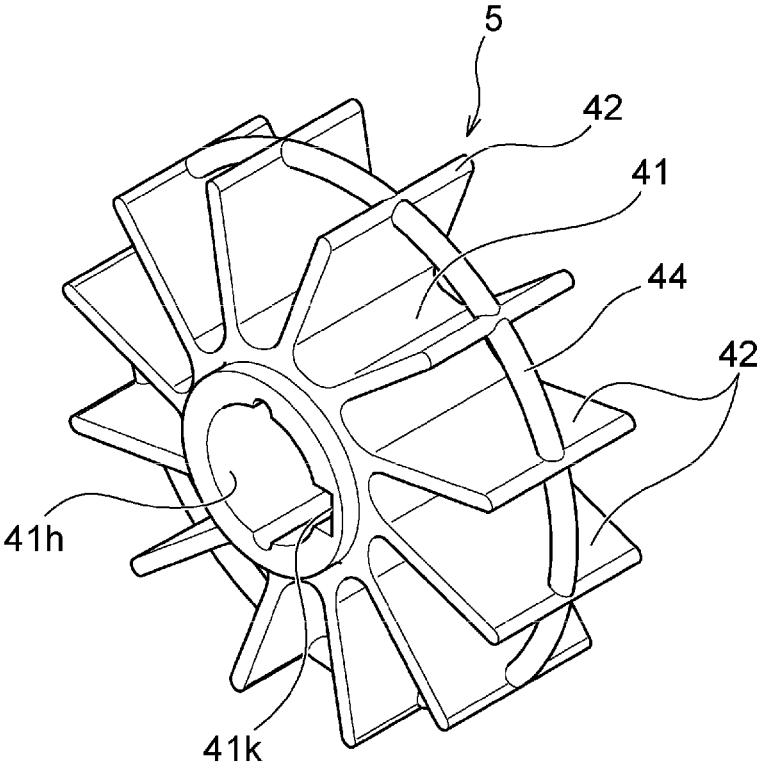
FIG. 9B is a perspective view showing a conventional second-stage impeller shown in FIG. 11.
Figure 11:
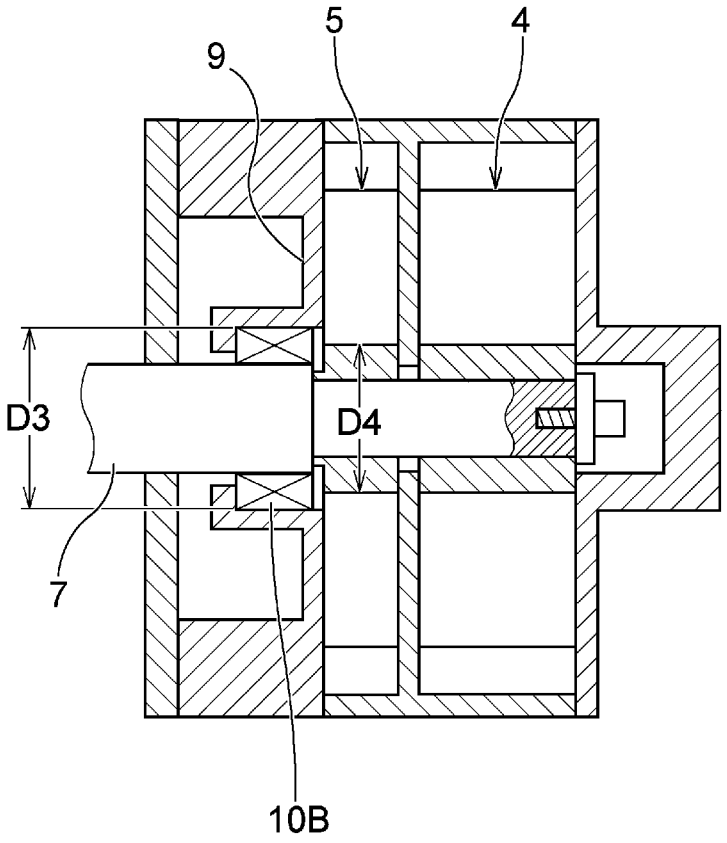
FIG. 11 is a schematic view showing main elements of a conventional liquid ring vacuum pump.

FIGS. 9A and 9B are perspective views showing the second-stage impeller 5 (FIG. 9A) according to the present invention shown in FIGS. 7 and 8 and showing the conventional second-stage impeller 5 (FIG. 9B) shown in FIG. 11.

As shown in FIG. 9A, the second-stage impeller 5 according to the present invention comprises a cylindrical boss portion 41, a plurality of blades 42 extending radially from the boss portion 41 at regular intervals, and a circular ring-shaped side plate 43 extending radially outwardly from the boss portion 41. The second-stage impeller 5 comprising the boss portion 41, the plurality of blades 42 and the side plate 43 is formed integrally by casting. The side plate 43 is provided on one end portion of the boss portion 41, and is positioned at a side facing the housing space for housing the shaft seal component 10B. Further, the side plate 43 is connected to an end surface 42*a* in a width direction of each blade 42 and an inner end 42*b* in a radial direction of each blade 42 (see FIG. 7). Further, a through hole 41*h* for allowing the main shaft 7 to be fitted therewith, a keyway 41*k* for allowing a key to be inserted therein, and the like are formed in the boss portion 41.

Although the conventional second-stage impeller 5 shown in FIG. 9B does not have the side plate 43 as shown also in FIG. 11, the conventional second-stage impeller 5 has a connecting ring 44 formed in a circular ring shape for connecting the adjacent two blades 42 to each other. The connecting ring 44 is provided on a forward end portion of each blade 42 and positioned at a central part in a width direction of each blade 42. The conventional second-stage impeller 5 is different from the second-stage impeller 5 according to the present invention shown in FIG. 9A in that the conventional second-stage impeller 5 does not have the side plate 43 but has the connecting ring 44.

In the conventional second-stage impeller 5, the connecting ring 44 is provided to increase rigidity of each blade 42. However, in the second-stage impeller 5 according to the present invention, because the rigidity of each blade 42 can be increased by the side plate 43, the connecting ring 44 can be omitted.

Figure 10A:
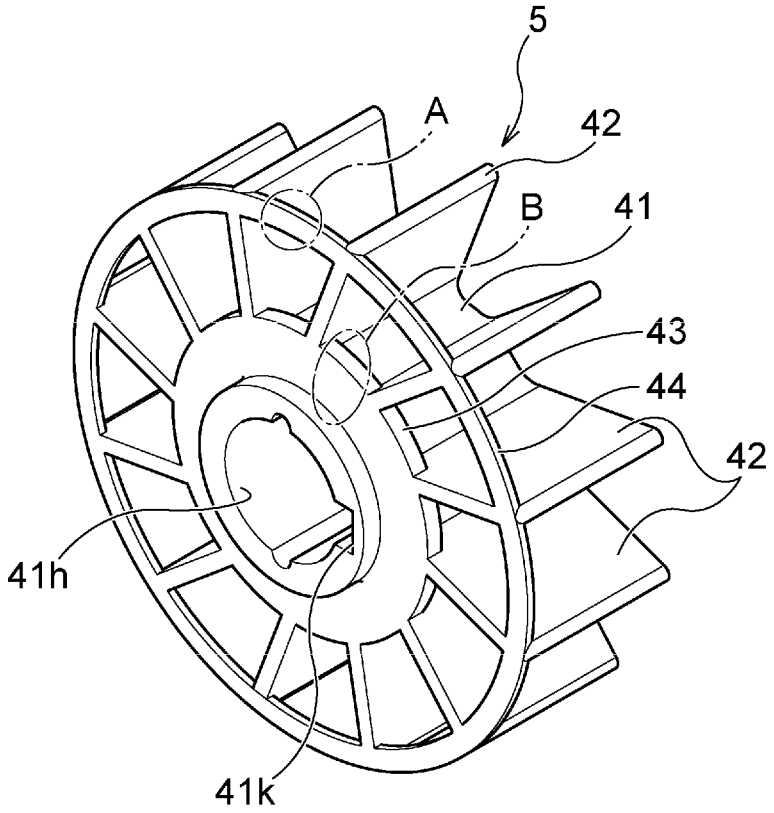
FIG. 10A is a perspective view showing a second-stage impeller according to another embodiment of the present invention.
Figure 10B:
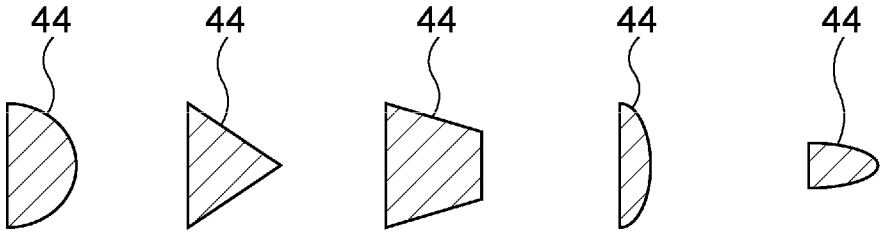
FIG. 10B is a schematic view showing cross-sectional shapes of A part of FIG. 10A.
Figure 10C:
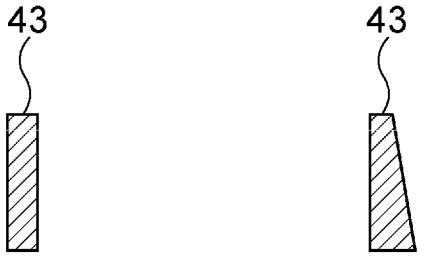
FIG. 10C is a schematic view showing cross-sectional shapes of B part of FIG. 10A.

FIG. 10A is a perspective view showing a second-stage impeller 5 according to another embodiment of the present invention. FIG. 10B is a schematic view showing cross-sectional shapes of A part of FIG. 10A. FIG. 10C is a schematic view showing cross-sectional shapes of B part of FIG. 10A.

As shown in FIG. 10A, the second-stage impeller 5 according to the present embodiment has a connecting ring 44 formed in a circular ring shape for connecting the adjacent two blades 42 to each other. Specifically, the second-stage impeller 5 according to the present embodiment uses the connecting ring 44 and the side plate 43 together. The connecting ring 44 is provided on a forward end portion of each blade 42 and positioned at an end portion in a width direction of each blade 42. Further, the connecting ring 44 is located radially outwardly of the side plate 43. The second-stage impeller 5 shown in FIG. 10A has other elements which are identical or similar to those of the second-stage impeller 5 shown in FIG. 9A.

FIG. 10B is a view showing cross-sectional shapes of the connecting ring 44. As shown in FIG. 10B, the cross-sectional shape of the connecting ring 44 includes a semicircle (left end), a triangle (the second from the left end), a trapezoid (the third from the left end), a semi-ellipse having a major axis in a vertical direction (the fourth from the left end), a semi-ellipse having a major axis in a horizontal direction (right end), and the like. Each cross-sectional shape of the connecting ring 44 has a tapered shape which is tapered from an end portion in a width direction of the blade 42 (left side in FIG. 10B) toward an inner side in the width direction of the blade 42 (right side in FIG. 10B).

FIG. 10C is a view showing cross-sectional shapes of the side plate 43. As shown in FIG. 10C, the cross-sectional shape of the side plate 43 includes a rectangle (left side), a trapezoid (right side), and the like. The cross-sectional shape of the side plate 43 shown in right side of FIG. 10C has a tapered shape which is tapered from the boss portion 41 toward an outer circumferential side of the blade 42.

The conventional second-stage impeller 5 shown in FIG. 9B and the second-stage impeller 5 according to the present invention shown in FIG. 10A will be described below from the standpoint of casting.

In the conventional impeller, as shown in FIG. 9B, the connecting ring 44 is positioned in parallel with a plane perpendicular to the axial direction of the main shaft 7 and at a central portion in the width direction of the impeller. Therefore, casting has been performed in such a manner that a division plane of an upper mold and a lower mold is set to the ring portion.

In the case where the connecting ring 44 and the side plate 43 are used together, if the connecting ring is formed at a central part in a width direction of the impeller as the conventional impeller, the division plane of the molds cannot be established to cause difficulty in manufacturing the impeller. Therefore, the side plate 43 and the connecting ring 44 are provided at an exhaust side of the second-stage impeller 5 and the cross-sectional shape of the connecting ring 44 is set to a semicircle as in the impeller according to the present invention shown in FIG. 10A, whereby division of the molds can be performed. As shown in FIG. 10B, the cross-sectional shape of the connecting ring 44 can be set to an arbitrary shape such as a polygon including a triangle and a trapezoid, or a semi-ellipse as long as the cross-sectional shape is selected from the shape such that the division of the molds can be performed Although the two-stage liquid ring vacuum pump having the two-stage impellers has been described in the embodiments, it should be noted that the present invention can be applied to a liquid ring vacuum pump having a single impeller.

Although the preferred embodiments of the present invention have been described above, it should be understood that the present invention is not limited to the above embodiments, but various changes and modifications may be made to the embodiments without departing from the scope of the appended claims.

INDUSTRIAL APPLICABILITY

The present invention is applicable to a two-stage liquid ring vacuum pump in which two-stage impellers are attached to an axial end portion of a main shaft (rotating shaft) of a motor. Further, the present invention is applicable to a liquid ring vacuum pump which has a circular casing, an impeller attached eccentrically with respect to a center of the circular casing, and a shaft seal part provided in a portion where the main shaft for supporting the impeller passes through the casing.

REFERENCE SIGNS LIST

1 first-stage pump chamber
2 second-stage pump chamber
3 casing
3*p* partition wall
4 first-stage impeller
5 second-stage impeller
6 motor
7 rotating shaft (main shaft)
8 intake-side cover
8*s* suction port
9 exhaust casing
9*d* discharge port
10A mechanical seal
10B shaft seal component

12 motor flange
13 motor casing
14 bearing
41 boss portion
41*h* through hole
41*k* keyway
42 blade
42*a* end surface in a width direction
42*b* inner end in a radial direction
43 side plate
44 connecting ring
D1 outer diameter of the first-stage impeller
D2 outer diameter of the second-stage impeller
D3 inner diameter of a space for housing the shaft seal component
D4 boss diameter of the second-stage impeller
D5 outer diameter of the side plate
LF liquid film (liquid ring)
Pd exhaust port
Ps intake port
Rb blade chamber
W1 width of the first-stage impeller
W2 width of the second-stage impeller

The invention claimed is:

1. A liquid ring vacuum pump comprising:

a casing for housing a sealing liquid;

an exhaust casing covering a rear side opening of the casing;

at least one impeller housed in the casing; and a shaft seal component provided in a portion where a main shaft for supporting the impeller passes through the exhaust casing;

wherein the impeller comprises a cylindrical boss portion having a hole for allowing the main shaft to be inserted therein, a plurality of blades extending radially outwardly from the boss portion, and a circular ring-shaped side plate extending radially outwardly from an outer circumference of the boss portion and positioned at a side facing the shaft seal component;

wherein an outer diameter of the side plate is larger than an inner diameter of a housing space, for housing the shaft seal component, formed in the exhaust casing;

wherein the exhaust casing has an exhaust port formed therein; and wherein the side plate has an outer circumference located more inwardly than the exhaust port in the radial direction of the impeller.

2. The liquid ring vacuum pump according to claim 1, wherein the side plate has at least one end surface which is in parallel with a plane perpendicular to an axial direction of the main shaft.

3. The liquid ring vacuum pump according to claim 1, wherein the side plate is connected to an end surface in a width direction of each blade and an inner end in a radial direction of each blade.

4. The liquid ring vacuum pump according to claim 1, wherein the impeller having the boss portion, the plurality of blades and the side plate is integrally formed by casting.

5. The liquid ring vacuum pump according to claim 1, further comprising a connecting ring formed in a circular ring shape for connecting the plurality of blades in a state where adjacent two blades are connected to each other;

wherein the connecting ring is positioned at an end portion in a width direction of each blade, and is positioned radially outwardly of the side plate.

6. The liquid ring vacuum pump according to claim 5, wherein the connecting ring has a tapered cross-sectional shape which is tapered from an end portion side in a width direction of each blade toward an inner side in the width direction of each blade.

7. The liquid ring vacuum pump according to claim 1, wherein the liquid ring vacuum pump comprises a two-stage liquid ring vacuum pump having a first-stage impeller at an intake side and a second-stage impeller at an exhaust side; and wherein the side plate is provided on the second-stage impeller.

8. The liquid ring vacuum pump according to claim 1, wherein an outer diameter of the boss portion is smaller than an inner diameter of the housing space in which the shaft seal component is housed.

9. The liquid ring vacuum pump according to claim 1, wherein the exhaust port is located more inwardly than outer ends of the plurality of blades in the radial direction of the impeller.

* * * * *